US007540755B1

(12) United States Patent
Wu

(10) Patent No.: US 7,540,755 B1
(45) Date of Patent: Jun. 2, 2009

(54) ELECTRICAL CONNECTOR ASSEMBLY WITH IMPROVED LATCHING MECHANISM

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/009,487

(22) Filed: Jan. 18, 2008

(51) Int. Cl.
*H01R 13/62* (2006.01)

(52) U.S. Cl. ..... 439/352; 439/357

(58) Field of Classification Search ..... 439/352, 439/357, 350, 351, 353–356, 358, 258
See application file for complete search history.

(56) References Cited

U.S. PATENT DOCUMENTS 5,011,424 A * 4/1991 Simmons ..... 439/352
5,915,987 A 6/1999 Reed et al.
6,568,950 B2 * 5/2003 Rudoy et al. ..... 439/352
7,134,914 B1 11/2006 Wu
7,232,329 B1 * 6/2007 Wu ..... 439/358
7,281,937 B2 10/2007 Reed et al.
2008/0311781 A1 * 12/2008 Wojcik et al. ..... 439/352

* cited by examiner

*Primary Examiner*—Gary F. Paumen
(74) *Attorney, Agent, or Firm*—Wei Te Chung

(57) ABSTRACT

An electrical connector assembly (100) includes a housing (1) having an outer peripheral; a latching mechanism (3) assembled to the outer peripheral of the housing (1), said latching mechanism (3) including a latching member (31) pivotally engaging with the housing (1) and a pull member (32) having an actuator portion (321) beneath the latching member (31); a cap member (4) assembled to the housing (1), with a spring member (441) thereof substantially pressing the latching member (31); and whereby movement of the actuator portion (321) causes the latching member (31) rotating upwardly.

20 Claims, 5 Drawing Sheets

ELECTRICAL CONNECTOR ASSEMBLY WITH IMPROVED LATCHING MECHANISM

BACKGROUND OF THE INVENTION

1. Field of the Invention

The present invention generally relates to an electrical connector assembly, more particularly to an electrical connector assembly with improved latching mechanism.

2. Description of Related Art

Small and low-profile connectors, such as those used in SFP (Small Form Factor Pluggable) applications are desired in electronic devices in which space is a premium. Such connectors are widely used to make connections with routers and servers. However, the connectors are often separated from the component of the aforementioned device, unintentionally.

Connectors, and particularly plug connectors, can be made more reliable and drawn out less likely by latching them together. U.S. Pat. No. 5,915,987 issued Jun. 29, 1999 to Reed et al. entitled, "Latched Electrical Connector" discloses a plug-receptacle connector assembly with a latching mechanism incorporated into the housing of the plug connector. One problem with the latching mechanism such as that disclosed in the '987 patent can not be applied to low-profile, high-density receptacle connectors. Their size and the side locations of the actuators for the latching mechanisms of such plug connectors would increase the size required in a system. Such connector also requires a tailored-designed housing to receive the plug connector. As connectors become smaller and as the density of receptacle connectors in electronic devices increases, the simple act of disengaging a plug connector latch mechanism becomes increasingly more difficult.

U.S. Pat. No. 7,281,937, issued Oct. 16, 2007 discloses a small, low-profile plug connector provides a latching mechanism, including a latching member with a pair of hooks that engage mating holes in a metal shell of an opposing connector, and which can be easily detached from the opposing connector, by way of a simple ramp and lobe mechanism in the plug connector. The ramp and lobe mechanism converts horizontal movement of a pull tab-like actuator into vertical movement of a latching member such that the hooks are lifted upward and disengaged from the metal shell of the opposing connector. Sufficient pull force must be exerted to the actuator to make the hooks to be lifted upward to leave the engaging mating holes in the metal shell of the opposing connector. However, the lobe mechanism may be sandwiched between a top surface of the plug and the latching member as incorrect operation, and it is unable to restore automatically. Further more, the latching member trends to be deformed, which causes hooks unable to lock the opposing connector.

Hence, an improved latching mechanism for an electrical connector assembly is highly desired to overcome the disadvantages of the related art.

SUMMARY OF THE INVENTION

Accordingly, an object of the present invention is to provide an electrical connector assembly with improved latching mechanism which is durable and operated easily.

In order to achieve the object set forth, an electrical connector assembly interconnection system in accordance with the present invention comprises a housing having an outer peripheral; a latching mechanism assembled to the outer peripheral of the housing, said latching mechanism including a latching member pivotally engaging with the housing and a pull member having an actuator portion beneath the latching member; a cap member assembled to the housing, with a spring member thereof substantially pressing the latching member; and whereby movement of the actuator portion causes the latching member rotating upwardly.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
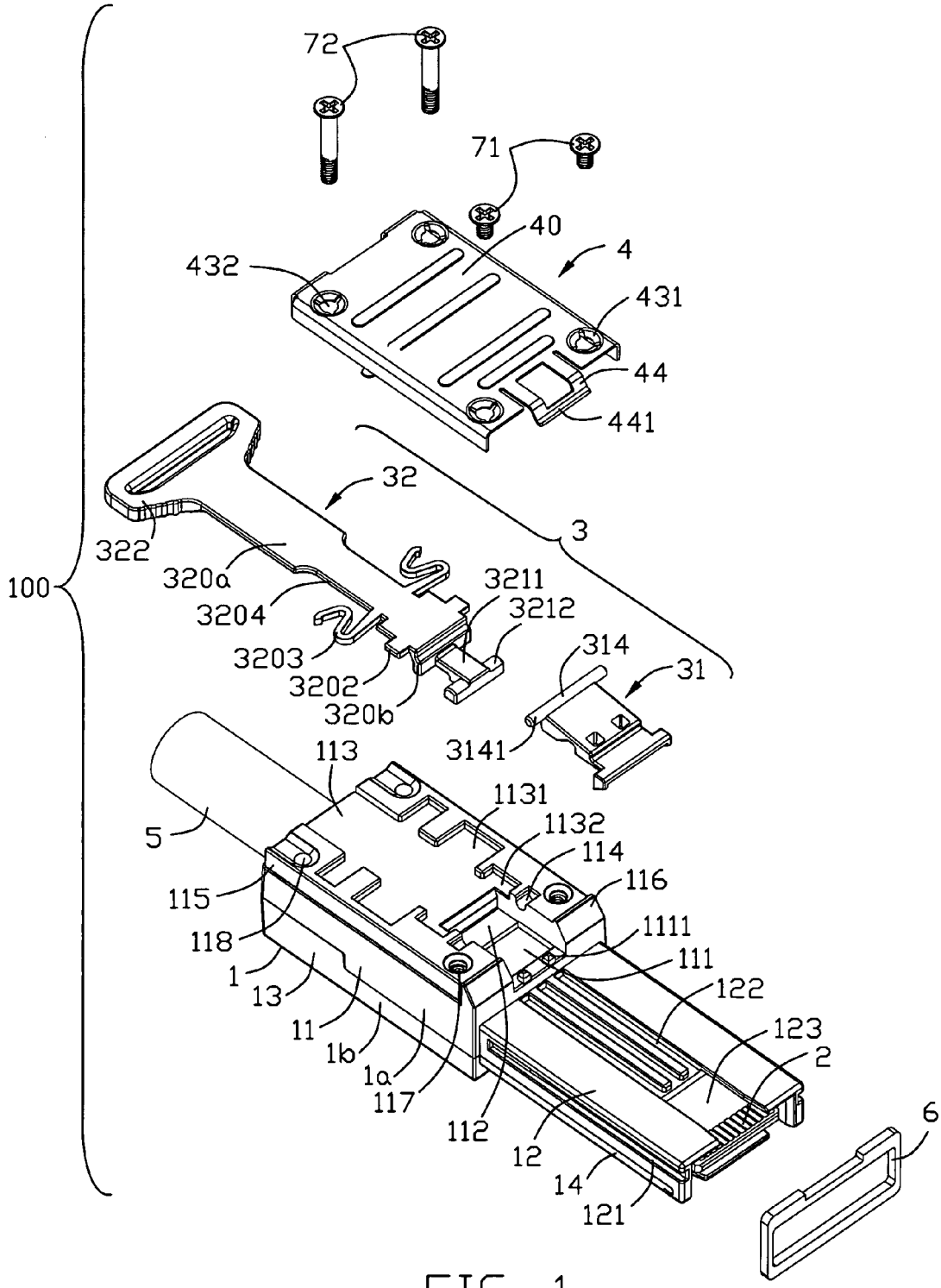
FIG. 1 is an exploded, perspective view of an electrical connector assembly in accordance with the present invention.
Figure 2:
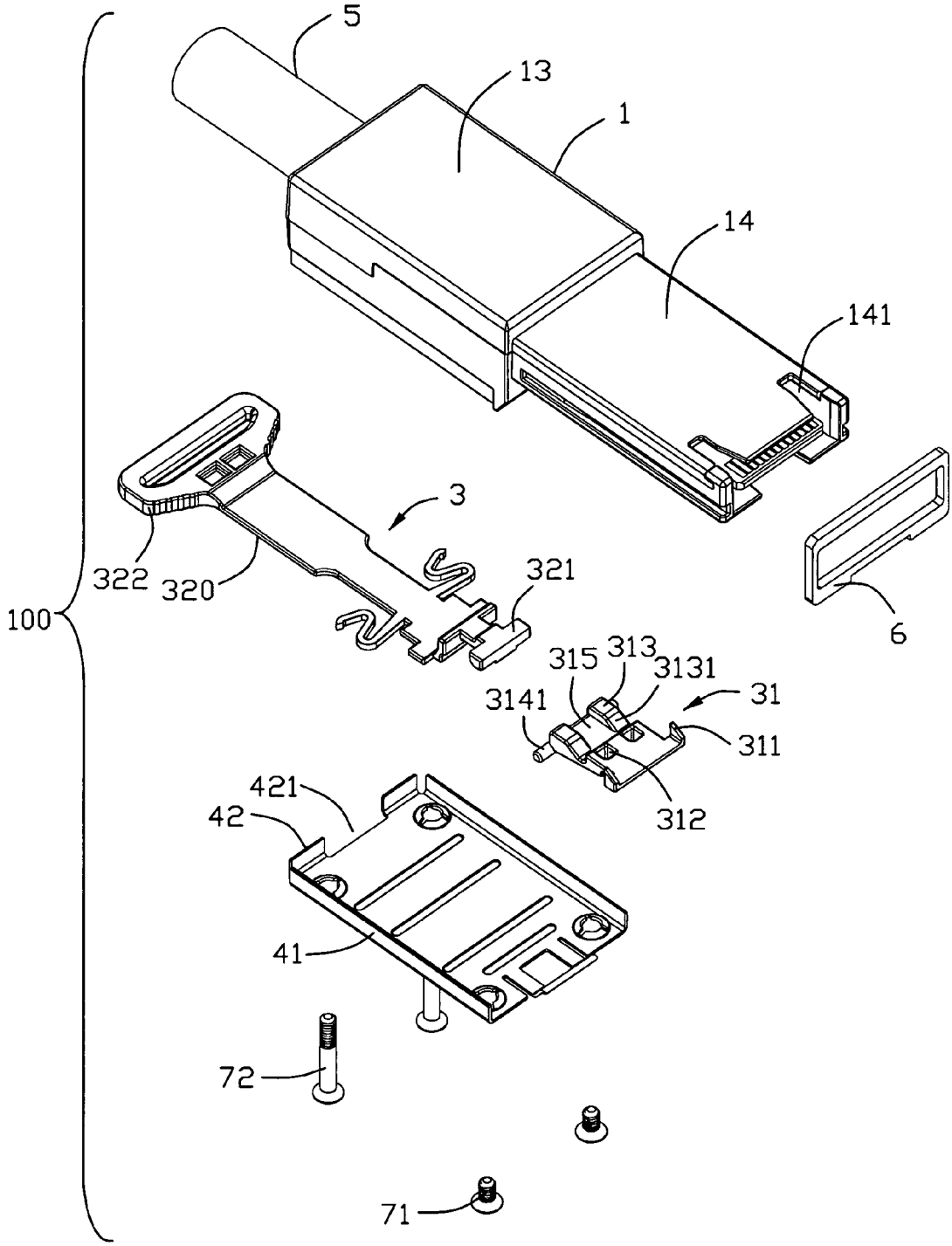
FIG. 2 is a view similar to FIG. 1, but viewed from another aspect.

Referring to FIGS. 1-2, an electrical connector assembly comprises a housing 1, a printed circuit board (PCB) 2 received in a hollow portion 10 enclosed by the housing 1, a latching mechanism 3 assembled to the housing 1, a cap member 4 partially covering the latching mechanism 3, a cable 5 coupled to rear end of the PCB 2, and an anti-EMI gasket 6.

The housing 1 includes a first piece 1*a* and a second piece 1*b* combined together to form the hollow portion 10. Both the first piece 1*a* and the second piece 1*b* are die-cast member.

The first piece 1*a* is composed of a base segment part 11 and a mating segment part 12 extending forward from lower front edge of the base segment part 11. A top outer peripheral of the base segment part 11 defines a first cavity portion 111, a second cavity portion 112 located at back of the first cavity portion 111. The first cavity portion 111 is deeper than the second cavity portion 112 and further has a front opening (not numbered). A pair of spaced protruding members 1111 are disposed in the front portion of the first cavity portion 111. Two mounting slots 114 recessed downward from top surface of the base segment part 11 are arranged two lateral sides of and communicate with the second cavity portion 112, each having an arched inward surface (not numbered). A shallow channel portion 113 is located at back of the second cavity portion 112, with a back opening (not numbered). A pair of broader first recess portions 1131 are laterally defined in a middle area of the top outer peripheral of the base segment part 11 and further communicate with the channel portion 113. A pair of second recess portions 1132 are disposed in front of the first recess portions 1131, communicating with the channel portion 113 and the second cavity portion 112.

The mating segment part 12 includes a pair of first keyways 121 arranged in transversal sides thereof, a front cutout 123 in a middle section of top side thereof and three juxtaposed keyways 122 at back of and communicating with the front cutout 123.

The second piece 1*b* is composed of a base segment part 13 and a mating segment part 14 extending forward from upper front edge of the base segment 11. A pair of narrow cutouts 141 are laterally defined in front segment of the mating segment part 14.

The latching mechanism 3 includes a latching member 31 and a pull member 32 for actuating the latching member 31. A pair of hook portions 311 are laterally formed at front section of the latching member 31 and protrude downward. A pair of through holes 312 are defined in a middle section of the latching member 31. A pair of projecting members 313 are formed on lateral sides of rear section of the latching member 31, each having a ramp surface 3131 thereof. The pair of projecting members 313 are spaced from one another, with a passageway 315 formed therebetween. A rod member 314 engages with rear edge of the latching member 31, with two lobe portions 3141 outward extending beyond side faces of the latching member 31, respectively.

The pull member 32 includes a main body 320, a pull portion 322 extending rearward from end edge of the main body 320 and an actuator portion 321 extending forwardly from front edge of the main body 320. The main body 320 is of L-shaped viewed laterally, including a horizontal segment 320*a* and a shorter vertical segment 320*b* extending downward from a front end of the horizontal segment 320*a*. A pair of cutouts 3204 are defined in lateral sides of a front section of the horizontal segment 320*a*, with a pair of sinuate spring members 3203 formed at front portions of the cutouts 3204, respectively. A pair of stop members 3202 are formed at lateral sides of the horizontal segment 320*a*, in front of the spring member 3023 and proximate to front end of the horizontal segment 320*a*. The actuator portion 321 is configured to substantially T-shaped, including a neck portion 3211 extending forward from lower middle portion of the vertical segment 320*b* and a pair of stub portions 3212 arranged lateral sides of a front section of the neck portion 3211. The stub portion 3212 further has an arched and smooth top surface (not numbered).

The cap member 4 is made of sheet metal and includes a planar top wall 40, a pair of transversal walls 41 extending downwardly from lateral edges of the top wall 40 and a back wall 42 extending downwardly from rear edges of the top wall 40. The back wall 42 defines a rectangular-shaped outlet 421 in the middle section thereof. A spring member 44 extends forwardly from front section of the top wall 40, with a downwardly inclined free end 441.

Figure 3:
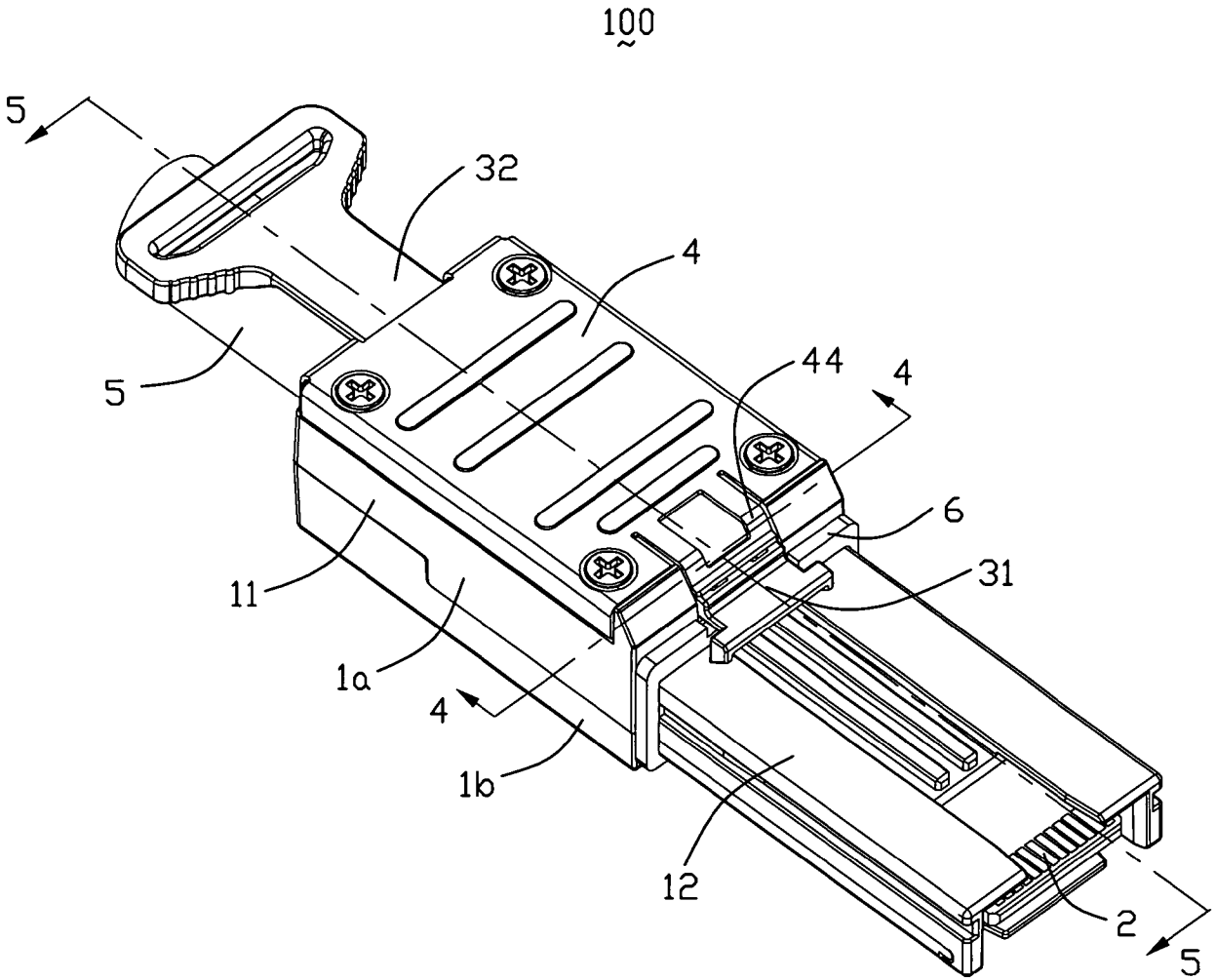
FIG. 3 is an assembled, perspective view of the electrical connector assembly shown in FIG. 1.
Figure 4:
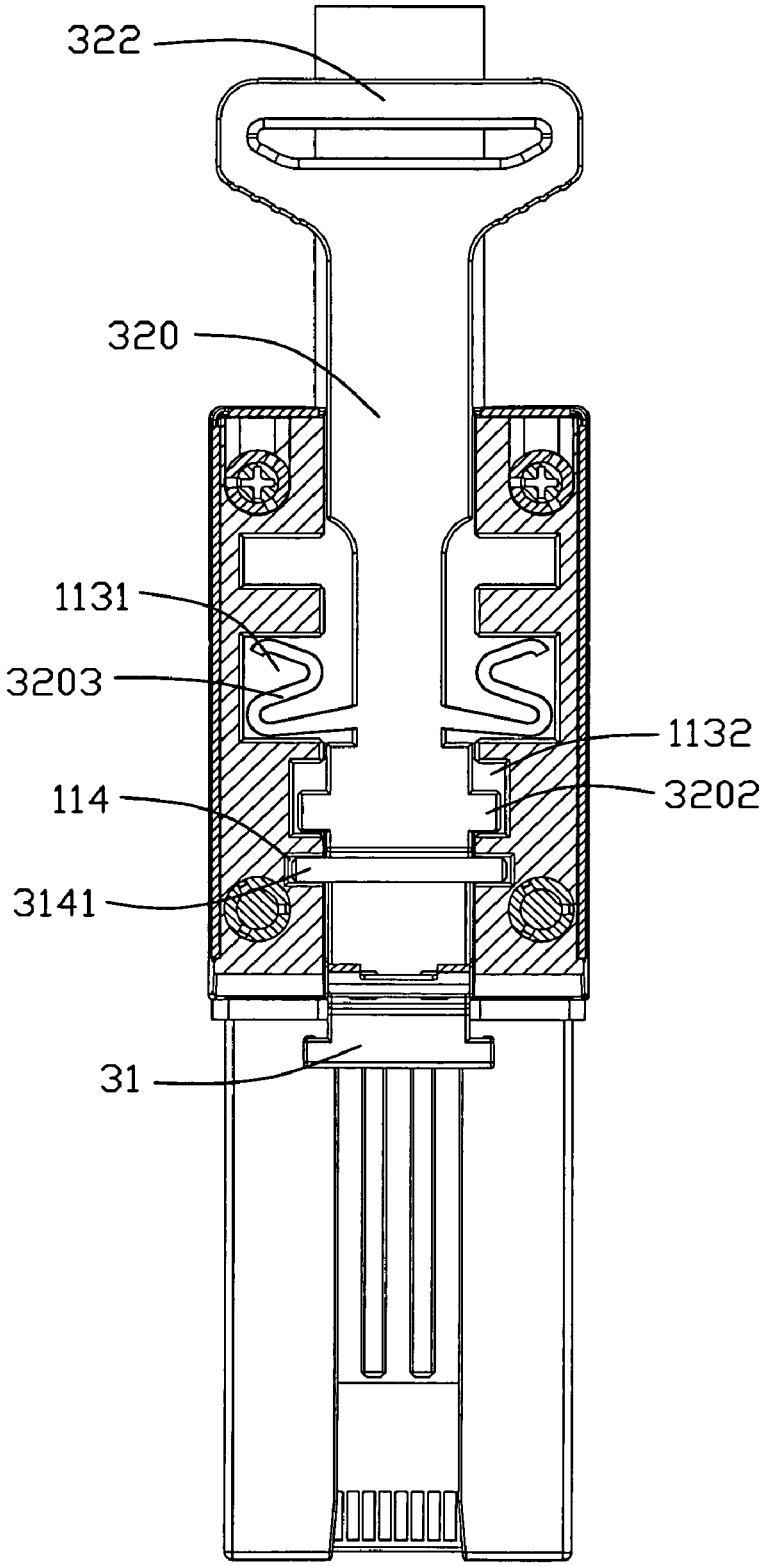
FIG. 4 is a cross-section view taken along line 4-4 of FIG. 3.
Figure 5:
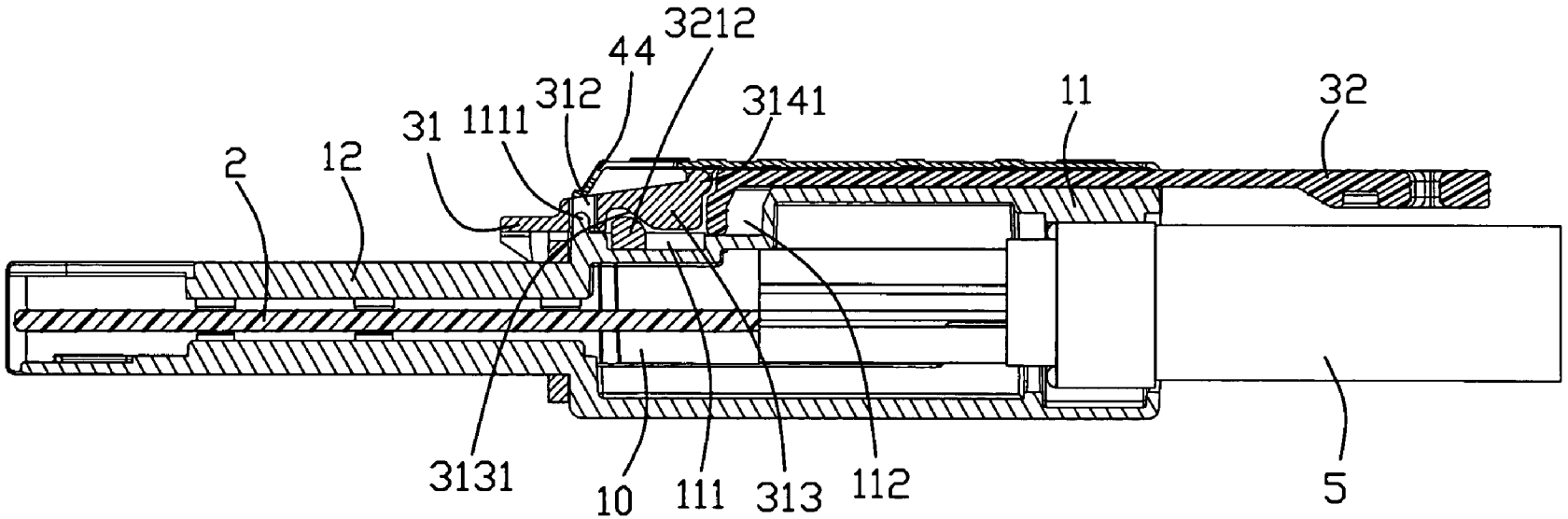
FIG. 5 is another cross-section view taken along line 5-5 of FIG. 3.

Referring to FIGS. 3-5, in conjunction with FIGS. 1-2, when the latching mechanism 3 is assembled to the housing 1, the pull member 32 is firstly mounted on the base segment part 11, with a front segment of the horizontal segment 320*a* thereof located in the channel portion 113, the vertical segment 320*b* thereof located in the second cavity portion 112, the spring members 3203 located in the first recess portions 1131, the stop members 3202 located in the second recess portions 1132. The neck portion 3211 of the actuator portion 321 is received in the second cavity portion 112, and the pair of stub portions 3212 thereof are received in the first cavity portion 111. Then, the latching member 31 is assemble to the housing 1, with the two lobe portions 3141 thereof respectively received in the two mounting slots 114 of the base segment part 11, the stub portions 3212 arranged beneath and contacting the ramp surfaces 3131 of the pair of projecting members 313, the neck portion 3211 being disposed in the passageway 315, the two protruding members 1111 inserting into the two through holes 312, and the pair of hook portions 311 disposed on a top surface of the mating segment part 12. Finally, the cap member 4 is assembled to the housing 1, with the pair of transversal walls 41 and the back wall 42 arranged in a pair of notches 115 of two lateral and rear sides of the base segment part 11, a front edge of the cap member 4 abutting against a pair of ridge portions 116 in the front of the housing 1, the free end 441 of the spring member 44 substantially pressing onto a top surface of the latching member 31, a rear portion of the main body 320 exiting outwardly through the outlet 421 of the rear wall 42, with the pull portion 322 disposed outward. A pair of first screws 71 and another pair of second screws 72 pass through a pair of first through holes 431 and another pair of second through holes 432 of the top wall 40 of the cap member 4, inserted into corresponding screw holes 117, 118 of the base segment parts 11 and 12 to combine the cap member 4 and the housing 1 together.

When the electrical connector assembly 100 mates with an opposing connector (not shown), the hook members 311 of the latching member 31 locking into mating holes in a metal shell of an opposing connector, to keep them combining together reliably. When the electrical connector assembly 100 disengages the opposing connector, a pull force exerted onto the pull portion 322 to make the actuator portion 321 move backward, causing the pair of stub portions 3212 sliding along ramp surfaces 3131 of the two projecting members 313 to urge the latching member 31 upwardly rotating around two lobe portions 3141, thus, the hook members 311 are lifted to disengage the mating holes of the metal shell of the opposing connector. When the pull force is released, the free end 441 of spring member 44 presses onto the latching member 31 to make it return to an original place, and the spring members 3023 of the pull member 32 offer a restore force to make it return to an original place. The pair of stop members 3202 only slide in the second recess portions 1113 to inhibit the pull member 32 rearward moving excessively.

The latching member 31 is pivoted with the housing 1, compared with the latching member fixed to the housing, just a small pull force is needed to actuate it disengaging the opposed connector. Further more, some inhibition method can prevent the pull member 32 rearward moving overmuch.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

a housing having an outer peripheral;

a latching mechanism assembled to the outer peripheral of the housing, said latching mechanism including a latching member pivotally engaging with the housing and a pull member having an actuator portion beneath the latching member;

a cap member assembled to the housing, with a spring member thereof substantially pressing the latching member; and whereby movement of the actuator portion causes the latching member rotating upwardly.

2. The electrical connector assembly as claimed in claim 1, wherein the latching member has two lobe portions arranged rear portion thereof accommodated in corresponding mounting slots in the housing.

3. The electrical connector assembly as claimed in claim 1, wherein the latching member has at least one projecting members with a ramp surface, wherein the actuator portion has at least one stub portion arranged under the projecting member, substantially contacting the ramp surface of the projecting member.

4. The electrical connector assembly as claimed in claim 1, wherein the pull member has a main body being of L-shaped viewed laterally, including a horizontal segment and a vertical segment extending downward from a front end of the horizontal segment, wherein the actuator portion is coupled to a lower portion of the vertical segment.

5. The electrical connector assembly as claimed in claim 4, wherein the outer peripheral of the housing define a channel portion and a cavity portion in front of the channel portion, wherein the horizontal segment of the pull member is received in the channel portion, the actuator portion together with partial of the latching member are received in the cavity portion, said latching member arranged above the actuator portion.

6. The electrical connector assembly as claimed in claim 5, wherein the outer peripheral of the housing defines a pair of first recess portions communicating with the channel portion, wherein a pair of spring members are formed at lateral sides of the pull member and further received in the pair of first recess portions.

7. The electrical connector assembly as claimed in claim 5, wherein the outer peripheral of the housing defines a pair of second recess portions communicating with the channel portion, wherein a pair of pair of stop members are formed at lateral sides of the pull member and further received in the pair of second recess portions.

8. The electrical connector assembly as claimed in claim 5, wherein the latching member defines at least one through hole in substantially middle section thereof, wherein a protruding member formed in the front of the cavity portion inserts into the through hole of the latching member.

9. An electrical connector assembly, comprising:

a housing composed of a base segment part and a mating segment part;

a latching mechanism including a latching member and pull member, said latching member having two lobe portions arranged at rear portion thereof and received in the two mounting slots in the base segment part of the housing, and the latching member further having a hook portion formed in the front portion thereof and disposed above top surface of the mating segment part;

a cap member assembled to the housing, with a spring member thereof substantially pressing the latching member; and whereby movement of the pull member causes the latching member upwardly rotating around the lobe portions.

10. The electrical connector assembly as claimed in claim 9, wherein the pull member includes a main body and a T-shaped actuator portion extending forward from front end of the main body.

11. The electrical connector assembly as claimed in claim 10, wherein the latching member has two projecting members, said the two projecting members spaced one another and each having a ramp surface.

12. The electrical connector assembly as claimed in claim 11, wherein the actuator portion composed of a neck portion connecting to the main body of the pull member and two stub portions formed at lateral sides of the neck portion, wherein the neck portion is interposed between the two projecting members and the stub portions are arranged under the two projecting members, substantially contacting the ramp surfaces thereof.

13. The electrical connector assembly as claimed in claim 10, wherein the pull member has a main body being of L-shaped viewed laterally, including a horizontal segment and a vertical segment extending downward from a front end of the horizontal segment, wherein the actuator portion is coupled to a lower portion of the vertical segment.

14. The electrical connector assembly as claimed in claim 13, wherein the outer peripheral of the base segment part defines a channel portion and a second cavity portion in front of the channel portion, wherein the horizontal segment of the pull member is received in the channel portion and the vertical segment of the pull member received in the second cavity portion.

15. The electrical connector assembly as claimed in claim 14, wherein the outer peripheral of the base segment part further defines a first cavity portion, in front of and deeper than the second cavity portion, wherein the stub portions of the actuator disposed in lower portion the first cavity portion, and wherein the latching member is partially disposed in upper portion of the first cavity portion.

16. The electrical connector assembly as claimed in claim 15, wherein the latching member defines two through holes in substantially middle section thereof, wherein a pair of protruding members formed in the first cavity portion insert into the through holes of the latching member.

17. The electrical connector assembly as claimed in claim 14, wherein the outer peripheral of the base segment part defines a pair of first recess portions communicating with the channel portion, wherein a pair of spring members are formed at lateral sides of the pull member and further received in the pair of first recess portions.

18. The electrical connector assembly as claimed in claim 14, wherein the outer peripheral of the base segment part defines a pair of second recess portions communicating with the channel portion, wherein a pair of pair of stop members are formed at lateral sides of the main body of the pull member and further received in the pair of second recess portions.

19. An electrical connector comprising:

a housing having an upward face;

a latching mechanism assembled to the upward face, said latching mechanism including a latching member pivotally moved with regard to the housing about a pivot axis and with a downward hook thereof, and said latching mechanism further including a pull member having an actuator portion beneath the latching member;

a cap member assembled to the housing, with a spring member thereof substantially pressing the latching member wherein other portions of said pull member is located under said cap member; wherein rearward pulling the pull member causes rearward movement of the actuator portion so as to have the latching member rotating upwardly.

20. The electrical connector as claimed in claim 19, wherein said actuator member is essentially located between the hook and the pivot axis in said front-to-back direction.

* * * * *